US008104576B2

(12) United States Patent
Schwoerer

(10) Patent No.: US 8,104,576 B2
(45) Date of Patent: Jan. 31, 2012

(54) SCAFFOLD STEPS

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 656 days.

(21) Appl. No.: 11/922,804

(22) PCT Filed: May 22, 2006

(86) PCT No.: PCT/EP2006/004848

§ 371 (c)(1),
(2), (4) Date: Jan. 15, 2009

(87) PCT Pub. No.: WO2006/136251

PCT Pub. Date: Dec. 28, 2006

(65) Prior Publication Data

US 2009/0205906 A1 Aug. 20, 2009

(30) Foreign Application Priority Data

Jun. 22, 2005 (DE) ..... 10 2005 028 885

(51) Int. Cl.
*E06C 7/16* (2006.01)

(52) U.S. Cl. ..... 182/120; 182/132; 182/178.1; 182/194; 182/228.1

(58) Field of Classification Search ..... 182/132, 182/178.1–178.5, 194, 115, 120, 127, 116, 182/228.1–228.3; 52/182, 183, 188, 190, 52/191

See application file for complete search history.

(56) References Cited

U.S. PATENT DOCUMENTS 773,972 A * 11/1904 Palmenberg ..... 248/235
1,113,368 A * 10/1914 Nesdall ..... 52/191
1,166,428 A * 1/1916 Brooks ..... 52/182
1,673,178 A * 6/1928 Bois ..... 52/191
2,760,707 A * 8/1956 Anderson ..... 182/115
3,672,106 A * 6/1972 Mulitz ..... 52/188
3,897,665 A * 8/1975 Yokomori ..... 52/188
3,978,628 A * 9/1976 Turner ..... 52/188
4,919,230 A * 4/1990 Langer et al. ..... 182/186.8
4,950,033 A * 8/1990 Anderson ..... 297/461
5,429,207 A * 7/1995 Frank et al. ..... 182/209
5,636,483 A * 6/1997 Wille ..... 52/188
5,944,293 A * 8/1999 Loy ..... 248/220.21
5,988,318 A * 11/1999 Krause ..... 182/222
6,003,634 A * 12/1999 Apostolopoulos ..... 182/150
6,283,249 B1 * 9/2001 Young et al. ..... 182/17

(Continued)

FOREIGN PATENT DOCUMENTS

CH 562 939 A 3/1973

(Continued)

OTHER PUBLICATIONS

"Design for Manufacturing." Corrado Poli (2001). http://books.google.com/books?id=3eBG9KFRQaMC&Ipg=PA171&dq=manufacturing%20bending%20and%20stamping&pg=PA171#v=onepage&q=manufacturing%20bending%20and%20stamping&f=false.*

(Continued)

*Primary Examiner* — Katherine Mitchell
*Assistant Examiner* — Johnnie A Shablack
(74) *Attorney, Agent, or Firm* — Kilpatrick Townsend & Stockton LLP

(57) ABSTRACT

The invention relates to scaffold steps, with two separate side pieces (11) and a plurality of separate step elements (13, 13', 13"), which can be detachably coupled to each other and to the side pieces.

20 Claims, 14 Drawing Sheets

U.S. PATENT DOCUMENTS

| | | | | |
|---|---|---|---|---|
| 6,415,891 | B1 * | 7/2002 | Hayman et al. | 182/178.1 |
| 6,691,828 | B1 | 2/2004 | Hayman et al. | |
| 6,895,717 | B1 * | 5/2005 | Grinstead | 52/182 |
| 6,966,406 | B2 * | 11/2005 | Nash, Jr. | 182/122 |
| 2003/0121215 | A1 * | 7/2003 | Schworer | 52/6 |
| 2004/0020142 | A1 * | 2/2004 | Kress | 52/185 |
| 2005/0097835 | A1 * | 5/2005 | Nishimoto et al. | 52/182 |

FOREIGN PATENT DOCUMENTS

| | | | |
|---|---|---|---|
| DE | 531 596 | A | 7/1931 |
| DE | 806 490 | C | 6/1951 |
| DE | 87 07 755 | U1 | 5/1987 |
| DE | 297 18 467 | U1 | 10/1997 |
| GB | 1 245 264 | | 9/1971 |
| WO | WO 99/20857 | A1 | 4/1999 |

OTHER PUBLICATIONS

Layher Das Geruest System, "Treppen, Treppentuerme, Aufstiege: Temporaere Aufstiege," Product Announcement, pp. 1-6 (Jul. 20, 2001).

* cited by examiner

SCAFFOLD STEPS

CROSS-REFERENCE TO RELATED APPLICATIONS

This application is a National Stage of International Application No. PCT/EP2006/004848, filed May 22, 2006, and which claims the benefit of German Patent Application No. 102005028885.5, filed Jun. 22, 2005, the disclosures of both applications being incorporated herein by reference.

BACKGROUND OF THE INVENTION

The invention relates to steps which are suitable, for example, for use in the construction of buildings or for industrial use and can thus be assembled and disassembled comparatively fast.

Construction stairways are known which include a plurality of individual step treads which are connected to one another at the side via fittings. Such a construction stairway can be pulled apart in the manner of a concertina for an intended use as steps and can be folded together in a space-saving manner for transport and for storage. On assembly, the construction stairway is pulled over square timbers in the pulled-apart state, the square timbers then forming the two side strings for the construction stairway and the step treads being able to be fixed to them.

Such a construction stairway with square timbers can be assembled fast and easily, but can only be handled with difficulty, and in particular not by a single person, due to its weight.

SUMMARY OF THE INVENTION

It is an underlying object of the present invention to provide steps which are easy to handle and can preferably be assembled and disassembled by one individual person.

This object is satisfied by scaffold steps which have two separate side strings and a plurality of separate step elements which can be releasably coupled both to one another and to the side strings.

In accordance with the invention, a plurality of individual parts with relatively low weight are provided in each case which, analog to construction scaffolding, can be assembled to form an intended total unit, in the present case to form steps. The steps assembled from the individual parts can subsequently be dismantled into their individual parts again since the coupling connections of the step elements are made releasable with respect to one another and between the side strings and the step elements.

An individual part, which has a much lower weight than the total scaffold steps, can be transported or carried individually and in particular by one single person. The scaffold steps in accordance with the invention can be handled particularly easily due to this and due to the releasable coupling of the individual parts and can be dismantled, in particular at different locations, quickly and easily by one single person.

Middle step elements, i.e. step elements which are arranged between a bottommost and an topmost step element in assembled scaffold steps, are in particular coupled both to the step element arranged directly thereunder and to the step element arranged directly above it so that particularly stable and reliable scaffold steps can be provided.

At least all the middle step elements and in particular also a bottommost step element can preferably each be coupled to the two side strings. A topmost step element can be made for technical construction considerations such that it cannot be coupled to the side strings, but only to the step element arranged directly thereunder and, optionally, to other components of the scaffold steps, for example to a horizontal latch or to a scaffolding platform.

A step element can form precisely one step of the assembled scaffold steps. It is, however, generally also possible for one step element to form two or more steps.

In accordance with a preferred embodiment of the invention, with assembled scaffold steps, the step elements are each secured against lift-off by step elements arranged directly above them. Particularly stable and reliable scaffold steps can hereby be provided. A topmost step element can be secured against lift-off by a scaffolding platform adjoining the topmost step element.

The scaffold steps can be assembled and disassembled particularly quickly and easily if two step elements can be coupled by threading through, pushing through, plugging in or engaging one or more connection elements of a step element in or through one or more recesses of an adjacent step element. A type of hinge or a rotatable joint can in particular be formed by the connection element and the recess so that the two step elements can be moved by rotation or pivoting relative to one another from a starting position enabling a lift-off of the upper of the two step elements into an end position preventing such a lift-off. In particular no further components such as screws or nuts are necessary to form the coupling connection.

A step element preferably has two limbs, in particular seen in cross-section, with one limb being made as a step tread and the other limb being made as a riser for the connection to an adjacent step element which is in particular arranged thereunder. With assembled scaffold treads, the step tread preferably extends at least substantially horizontally such that a person going up or down the scaffold steps can find a secure footing. The riser, which preferably extends substantially perpendicularly, can be provided as a type of protective device so that a person cannot move, or cannot move too far, between two adjacent step treads with a foot or even with a leg.

In particular at least one connection element, in particular a lug extending away from the limb or from a section thereof in a straight or oblique manner or at a right angle, can be provided at one limb and at least one recess can be provided in the other limb, in particular in its end region remote from the one limb, with at least one connection element of the one limb of an adjacent step element, in particular arranged thereunder, engaging into the recess with assembled scaffold steps.

In accordance with a further preferred embodiment of the invention, at least one limb is angled along at least one edge extending in the transverse direction of a step element. The end region of the step tread remote from the riser can, for example, be angled upwardly so that a person can haptically recognize the depth of the riser. A section of the riser can be angled rearwardly to increase the depth of the step tread. Additionally or alternatively, a section, in particular a smaller section, of the riser can be forwardly angled to form a security against lift-off.

Step elements can preferably each be manufactured from one single areal element by stamping and bending; i.e. the step elements are each made in one piece. The step elements can thereby be manufactured particularly easily.

To be able to grip, carry and handle the step elements particularly easily, a respective gripping opening can be formed in step elements, in particular in risers.

Holding devices can be formed, in particular attached, preferably welded, to both side strings for the holding of step elements. Respective holding devices are preferably provided at least for the middle step elements and the bottommost step element.

A holding device can have at least one projection which in particular projects upwardly from the side string, and is preferably of hook-shape, mushroom-shape or pin-shape and engages into a lateral cut-out of a step element or into a lateral opening of a step element in the assembled scaffold steps. A security against lift-off can be achieved for the respective step element by the engagement of the projection into the cut-out or into the opening. The step element can preferably be moved by rotation or pivoting into an end position in which the projection engages into the cut-out or the opening. In particular no further components such as screws or nuts are necessary to form the coupling connection between the step elements and the side strings.

It is particularly advantageous if a holding device has two projections, in particular arranged sequentially, with in particular one projection engaging into a lateral cut-out and the other projection engaging into a lateral opening. The engaging sections of the two projections preferably face one another so that the step element, in particular its riser, is arranged between the two projections with assembled scaffold steps in order thus to prevent a movement of the respective step element in the longitudinal direction of the scaffold steps.

The holding devices provided at the side strings can in particular additionally have a respective support surface on which at least a part of a step element, in particular a limb formed as a step tread, can be supported. It is hereby achieved that the larger part of the weight which acts on a step element on loading is directly supported by the side strings and does not have to be carried by the coupling connections with the adjacent step elements.

The one end of the side strings of the scaffold steps in accordance with the invention can generally be supported at the base, for example, and the other end can be fixed to a wall, for example. Generally, no further individual parts are thus necessary for the scaffold steps in accordance with the invention. To enable a free erection of the scaffold steps, however, preferably at least four vertical supports and/or at least two longitudinally extending horizontal latches are provide for the connection of two respective vertical supports, with each side string being fastened, in particular releasably fastened, to at least one vertical support and/or to one longitudinally extending horizontal latch.

It is furthermore preferred for a branching latch to be formed, in particular attached, preferably welded, to an end of each side string, with the side string being able to be fastened to a vertical support beneath a topmost step element of assembled steps by means of the latch. This allows the actual end of the side string to not have to be fastened to the vertical support so that a fastening position located at the level of the actual end of the side string, for example a rose of a vertical support, can remain free for a horizontal latch of a further level of a scaffolding, in particular with further scaffold steps.

A topmost step element can differ in construction from the other step elements. The step tread of the topmost step element can, for example, be made differently or can be completely omitted, in particular when a scaffolding platform adjoins the topmost step element. The topmost step element can furthermore be made such that it cannot be coupled to the side strings.

It is furthermore proposed that at least a plurality of step elements are made the same among one another. The middle step elements and the bottommost step element are in particular made the same. A high number of similar components enables a fast and uncomplicated erection, in addition to a cost-effective manufacture, since a time-consuming sorting of the individual parts can be omitted and/or a mixing up of individual parts can hardly ever occur.

For the engaging, hooking in or latching in a transversely extending horizontal latch, a limb of a topmost step element extending horizontally in the assembled state can be downwardly angled along an edge extending in the transverse direction of the topmost step element.

The side strings, horizontal latches and/or railing elements can preferably be hung to fastening positions, in particular roses of vertical supports.

The scaffold steps or parts thereof can be produced from metal, from a metal alloy, from steel, from plastic or from a composite material.

The invention will be described in the following by way of example with reference to the drawing.

DESCRIPTION OF THE PREFERRED EMBODIMENTS

Figure 1:
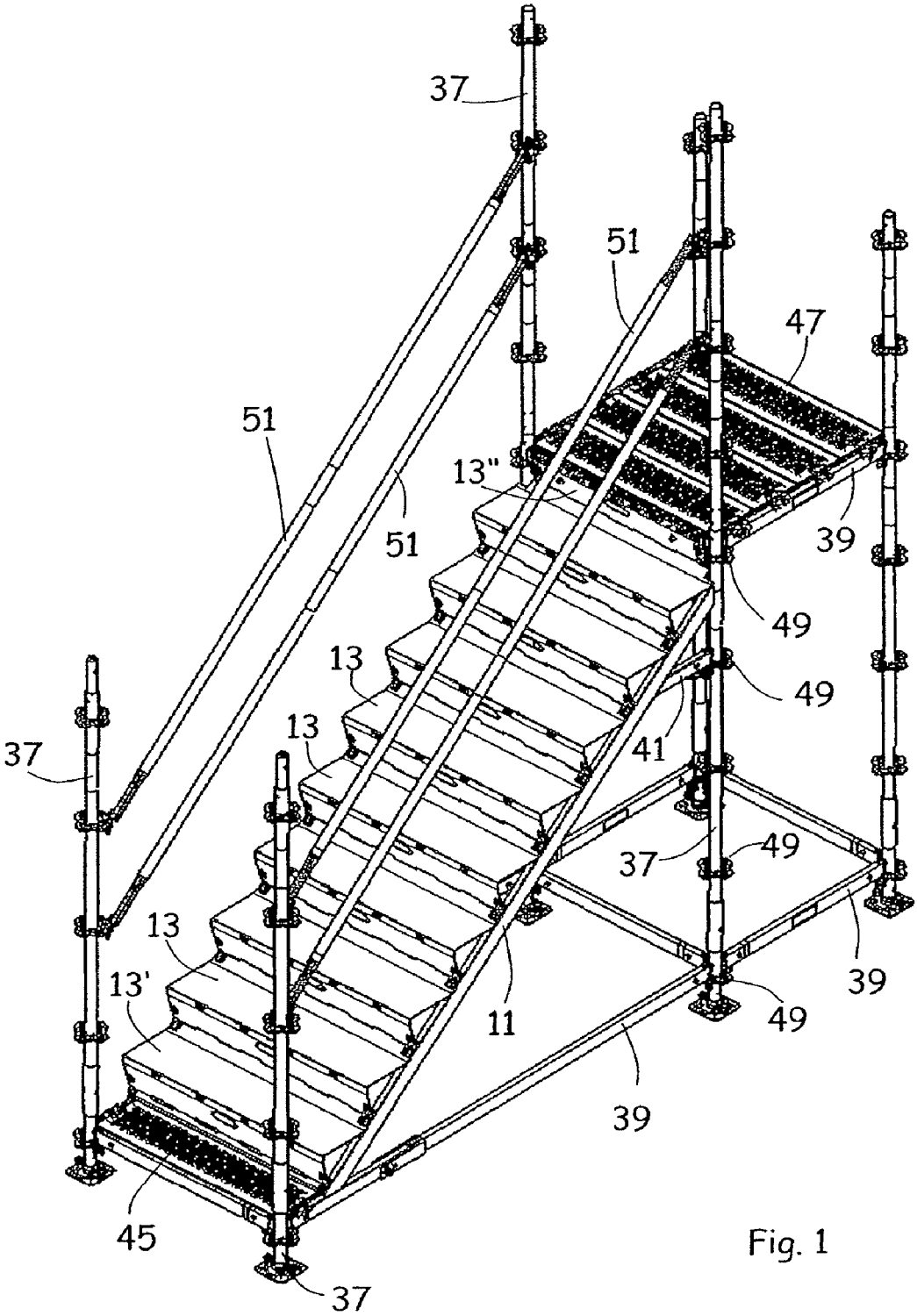
FIG. 1 is a perspective view of scaffold steps in accordance with the invention.

The scaffold steps in accordance with the invention shown in the assembled state in FIG. 1 consist of metal and include a bottommost step element 13', a plurality of middle step elements 13 and a topmost step element 13". The bottommost step element 13' and the middle step elements 13 are all made the same. Only the topmost step element 13" differs in its design.

Two respective adjacent step elements 13, 13', 13" are releasably coupled to one another. The bottommost step element 13' and the middle step elements 13 are additionally releasably coupled to two side strings 11. The releasable couplings will be described in more detail at a different point.

Furthermore, the scaffold steps in accordance with the invention have three respective multi-part vertical supports 37 at both sides to which roses 49 are respectively attached at predetermined levels. Furthermore, two longitudinally extending horizontal latches 39 are provided at both sides and connect two respective vertical supports 37 to one another. The longitudinally extending horizontal latches 39 are each hung at their two ends to roses 49 of the vertical supports 37.

The one end of the side strings 11 is welded in each case to the longitudinally extending horizontal latches 39 arranged between the front and middle vertical supports 37. Alternatively, the lower end of the side strings 11 and the longitudinally extending horizontal latch 39 can, however, also be releasably fastened to one another with a U-shaped clamp, known per se, open toward the bottom and fastened to the side string 11. A respective horizontally aligned branching latch 41 is welded to the upper end of the clamp at the side strings 11, and the side strings 11 are hung beneath the topmost step element 13" in each case at roses 49 of the middle vertical supports 37 by means of the latch.

Furthermore, a scaffold platform 47 is provided which adjoins the topmost step element 13", consists of a plurality of individual platforms and is hung at roses 49 of the middle and rear vertical supports 37. A further scaffold platform 45 consisting of one single platform is provided beneath the bottommost step element 13'.

Two railing elements 51 are provided between the front and middle vertical supports 37 on both sides of the scaffold steps in accordance with the invention, the railing elements being hung at rosettes 49 of the front and middle vertical supports 37, extending parallel to the side strings 11 and serving for the stabilization of the scaffold steps in accordance with the invention and simultaneously as security for persons and as a handrail.

Figure 2:
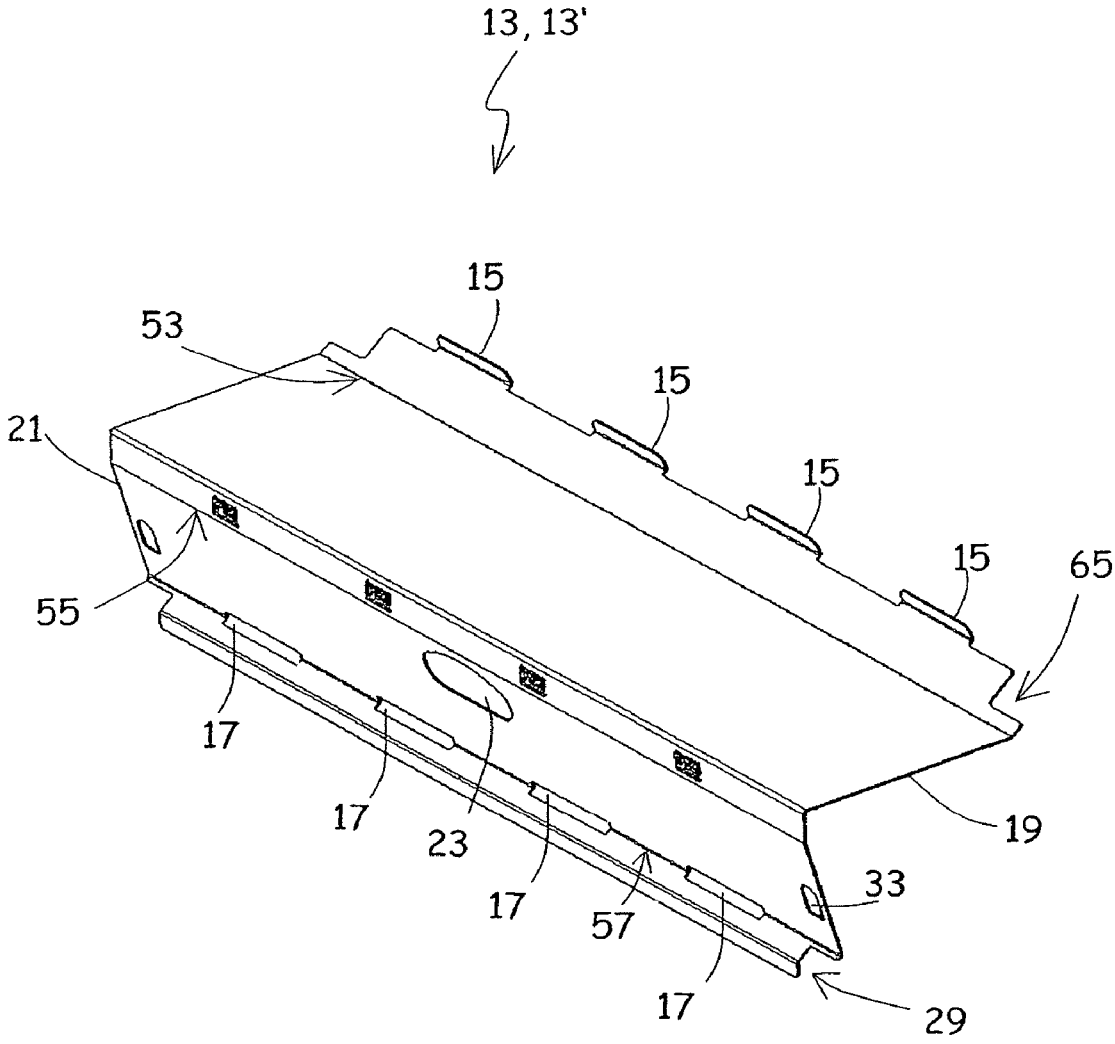
FIG. 2 is a perspective view of a middle step element of scaffold steps in accordance with the invention.

FIG. 2 shows a step element 13, 13' of the scaffold steps in accordance with the invention as is used for the bottommost step element 13' and the middle step elements 13. The step element 13, 13' is manufactured from an individual metal sheet by stamping and bending and has two limbs 19, 21, with the one limb 19 forming a step tread and the other limb 21 forming a riser. The step tread 19 can, contrary to what is shown in FIG. 2, be holed or perforated like the scaffolding platforms 45, 47 in order thus in particular to form a protection against sliding.

The step tread 19 is upwardly angled along an edge 53 extending in the transverse direction of the step element 13, 13', with a dimple 65 being formed at both sides on the angled section. Furthermore, the step tread 19 includes four lugs 15 which are arranged next to one another, which each have an L shape seen in cross-section and which each extend obliquely upwardly away from the step tread 19.

The riser 21, which has a grip opening 23 for gripping and carrying, is backwardly angled in its end region facing the step tread 19 along an edge 55 extending in the transverse direction of the step element 13, 13' and is forwardly angled in its end region remote from the step tread 19 along an edge 57 extending in the transverse direction of the step element 13, 13'. The section bounded by the edges 55 and 57 has a respective opening 33 at both sides and the forwardly angled section has a respective cut-out 29 at both sides.

Furthermore, four window-like recesses 17 are formed in the region of the edge 57 which are arranged next to one another and into which four lugs 15 of the step tread 19 of a step element 13, 13' arranged directly thereunder engage with assembled scaffold steps to establish a coupling connection.

At each side string 11, respective holding devices 25 (FIGS. 3 to 5) are provided for the bottommost step element 13' and for each of the middle step elements 13 and serve for the holding of the step elements 13, 13' at the side strings 11.

Figure 4:
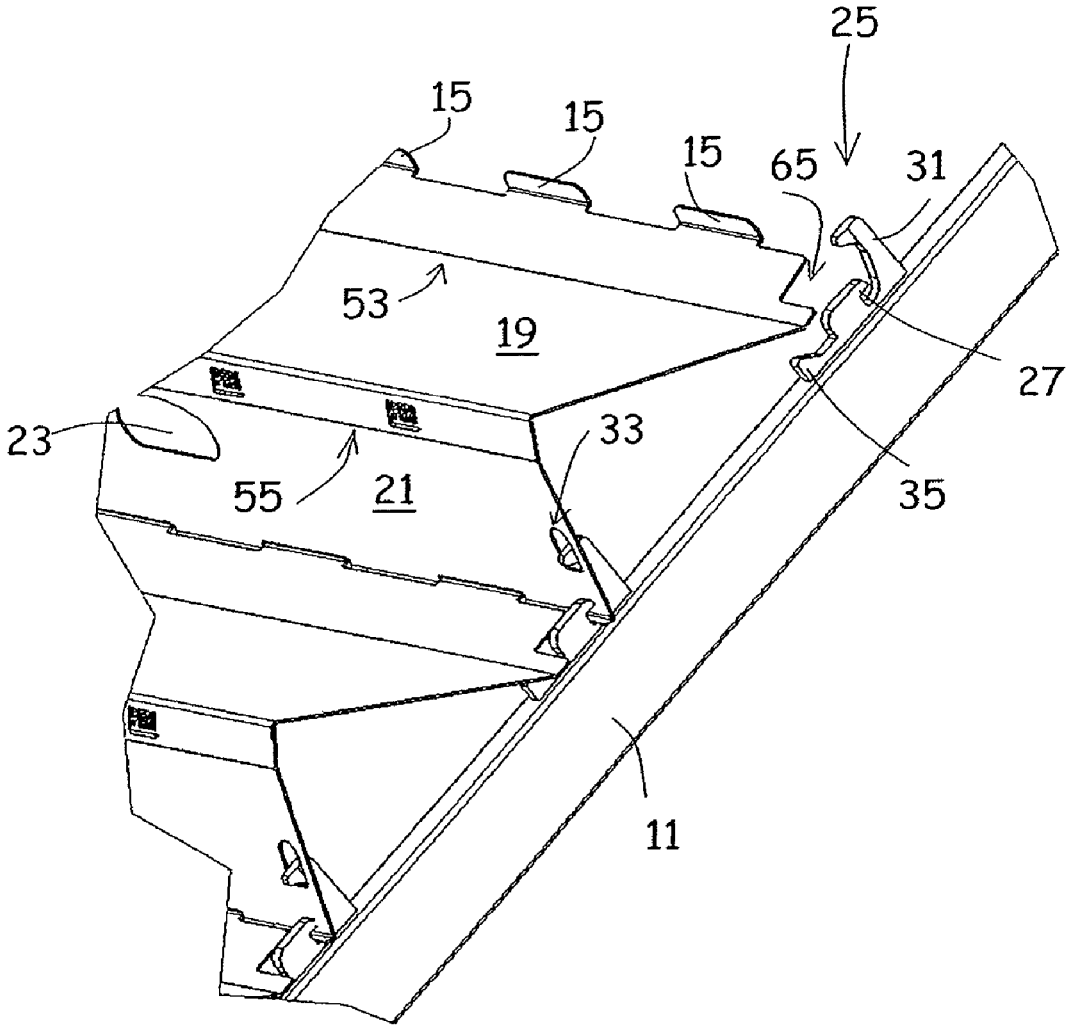
FIG. 4 is a perspective view of a section of scaffold steps in accordance with the invention with an almost completely assembled step element.
Figure 5:
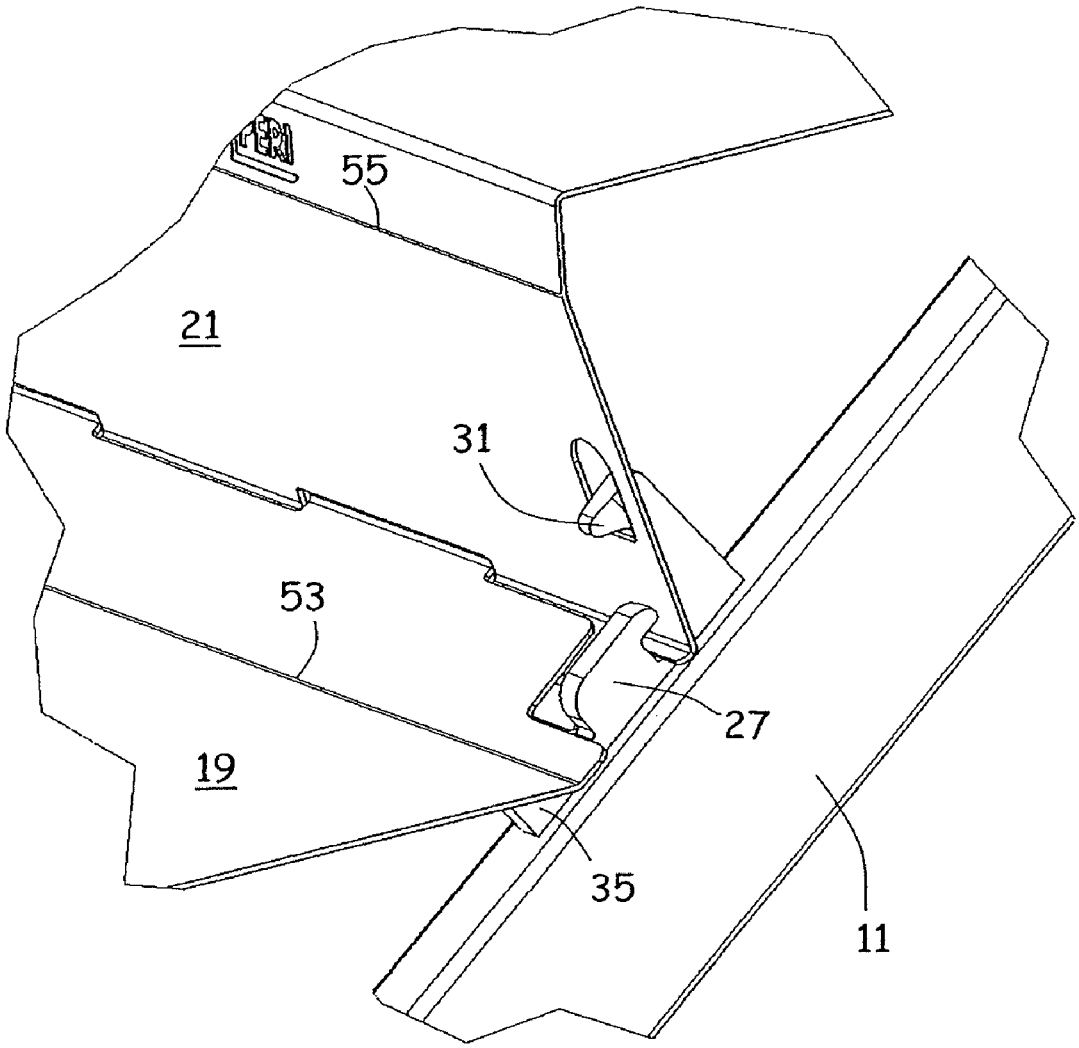
FIG. 5 is a perspective view of a section of scaffold steps in accordance with the invention with a completely assembled step element.

In accordance with FIG. 4, one holding device 25 includes two sequentially arranged, upwardly projecting hook-like projections 27, 31 which are welded to the side string 11. With assembled steps, the projection 27 engages into the cut-out 29 and the projection 31 engages into the opening 33 of the corresponding side of a step element 13, 13'. The engaging sections of the projections 27, 31 face one another in this connection. Furthermore, a holding device 25 includes a support surface 35 for the step tread 19 of a step element 13, 13' arranged directly thereunder.

Figure 6:
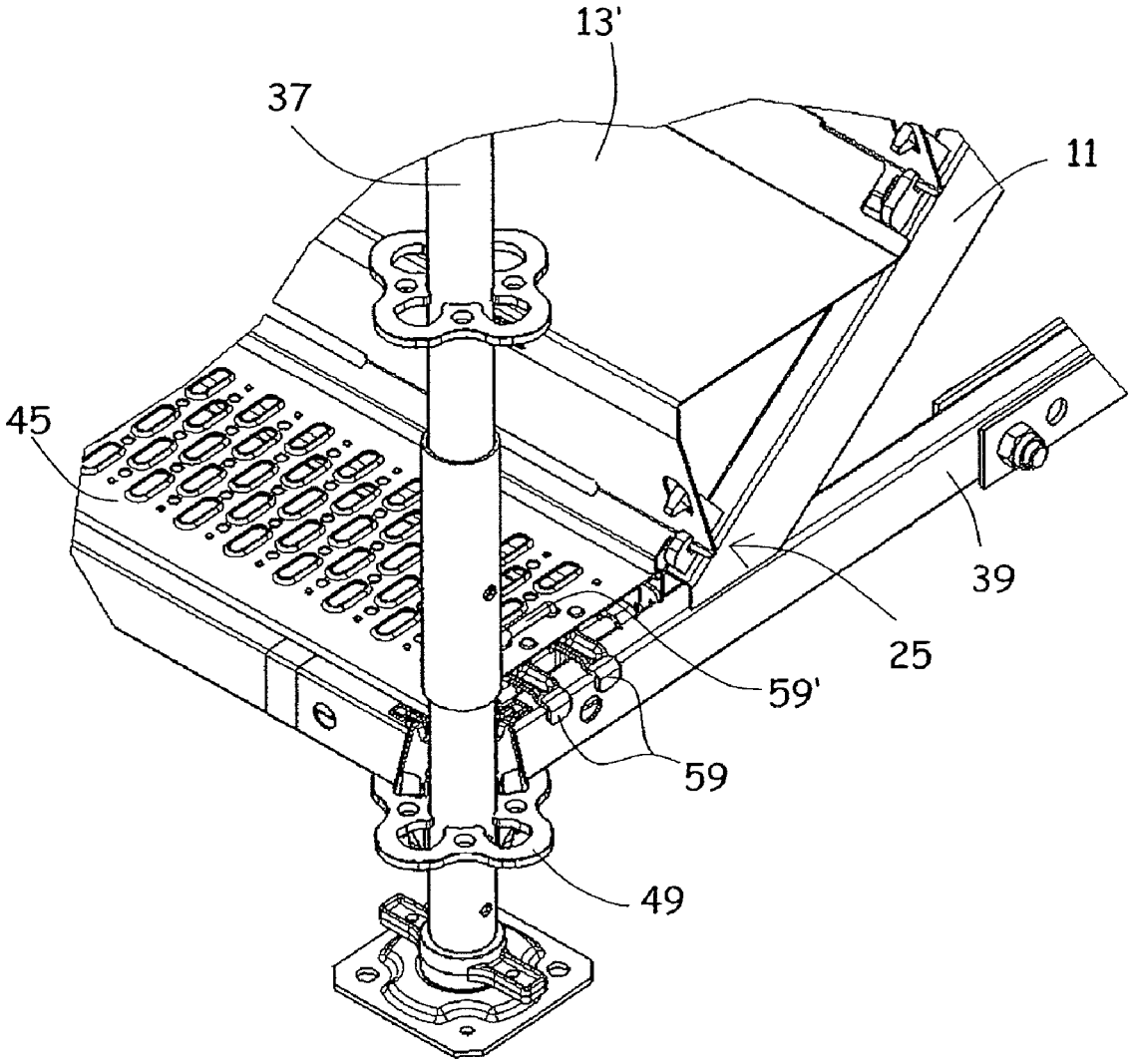
FIG. 6 is a perspective view of the bottommost step element and of a scaffolding platform arranged beneath the bottommost step element.

The holding devices 25 for the bottommost step element 13' have no support surfaces (FIG. 6). The holding devices 25 for the topmost step element 13", in contrast, have no projections (FIG. 7).

In accordance with FIG. 6, the scaffolding platform 45 arranged beneath the bottommost step elements 13' is fastened to longitudinally extending horizontal latches 39 using conventional cap and securing yokes 59, 59' and is thus secured against lift-off in a known manner.

Figure 7:
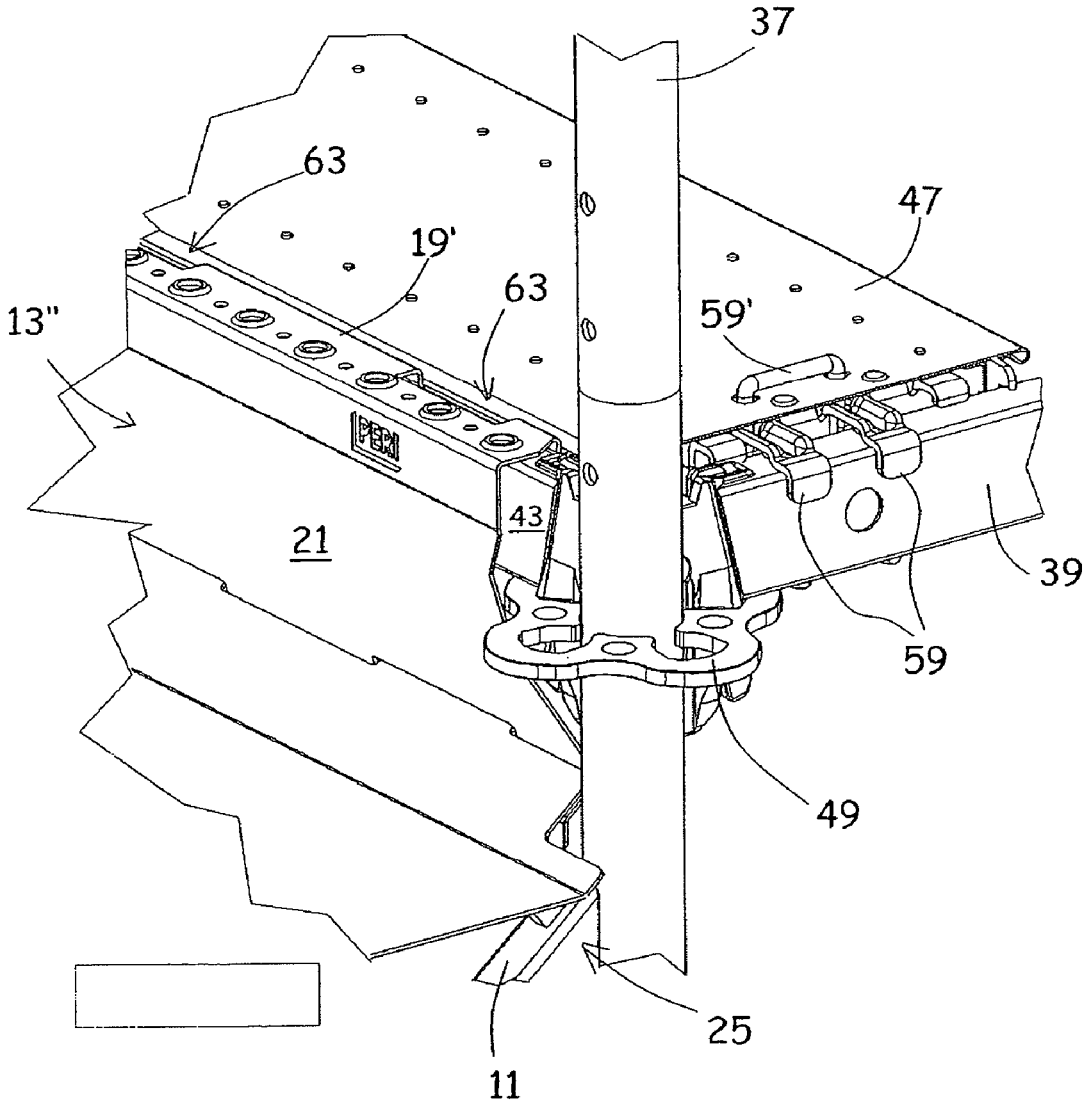
FIG. 7 is a perspective view of the topmost step element and of a scaffold platform adjoining it.

FIG. 7 shows the topmost step element 13" and a transversely extending scaffolding platform element of the scaffolding platform 47 adjoining it. The topmost step element 13' is made with two limbs and includes a short step section 19' and a riser 21. The riser 21 of the topmost step element 13" is formed analog to the riser 21 of the bottommost step element 13' and to the risers 21 of the middle step elements 13.

Figure 8:
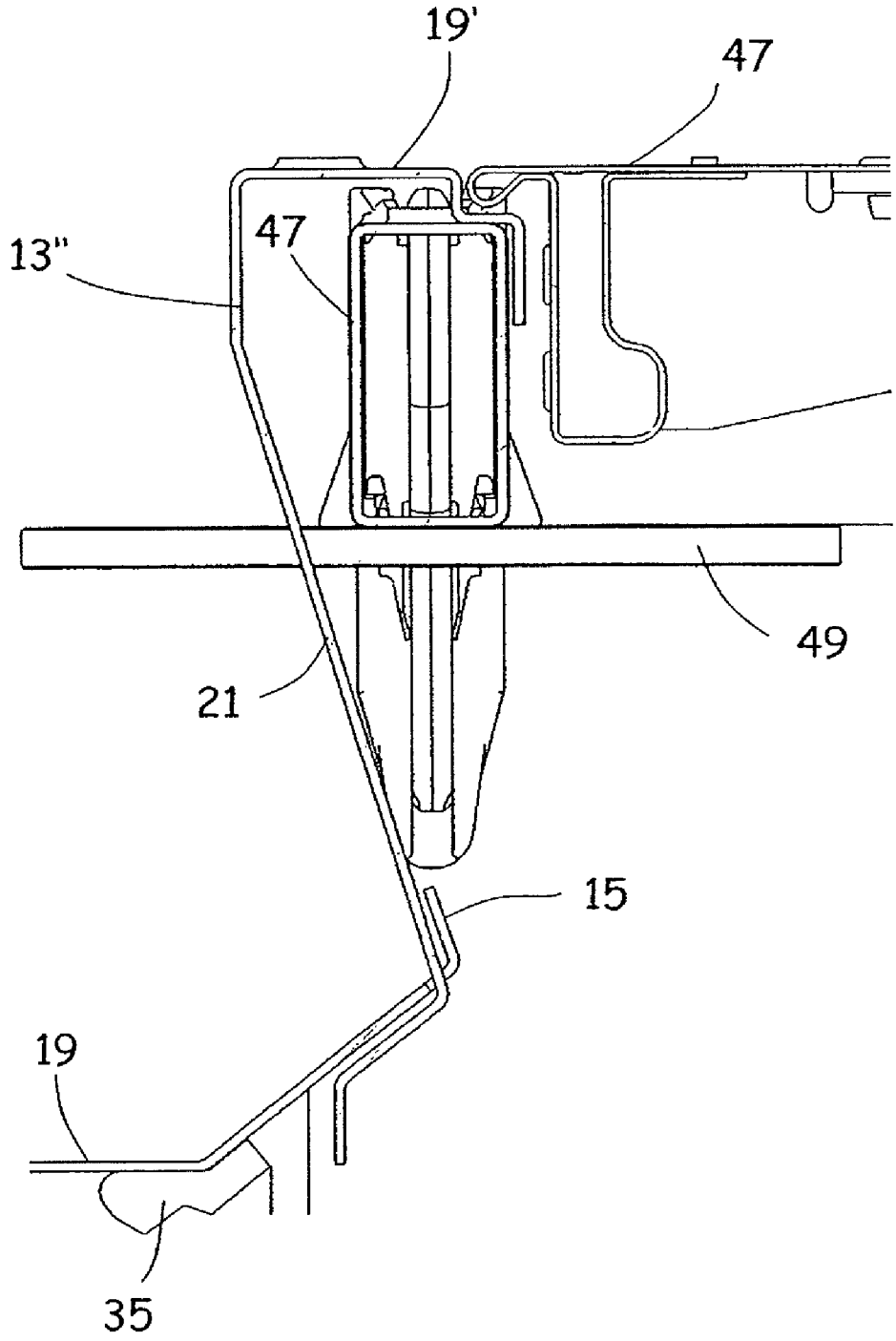
FIG. 8 is a cross-section through the topmost step element and a scaffold platform adjoining it and having transversely extending scaffold platform elements.

The step tread section 19' of the topmost step element 13" is, unlike the step tread 19 of the bottommost step element 13' and the step treads 19 of the middle step elements 13, not angled upwardly, but downwardly (FIG. 8) to enable an engaging, hooking or latching into a transversely extending horizontal latch 43. As a security against lift-off, the transversely extending scaffolding platform element of the scaffolding platform 47 adjoining the topmost step element 13" is fastened to longitudinally extending horizontal latches 39 using conventional cap and securing yokes 59, 59', as can in particular be recognized in FIG. 7.

Figure 9:
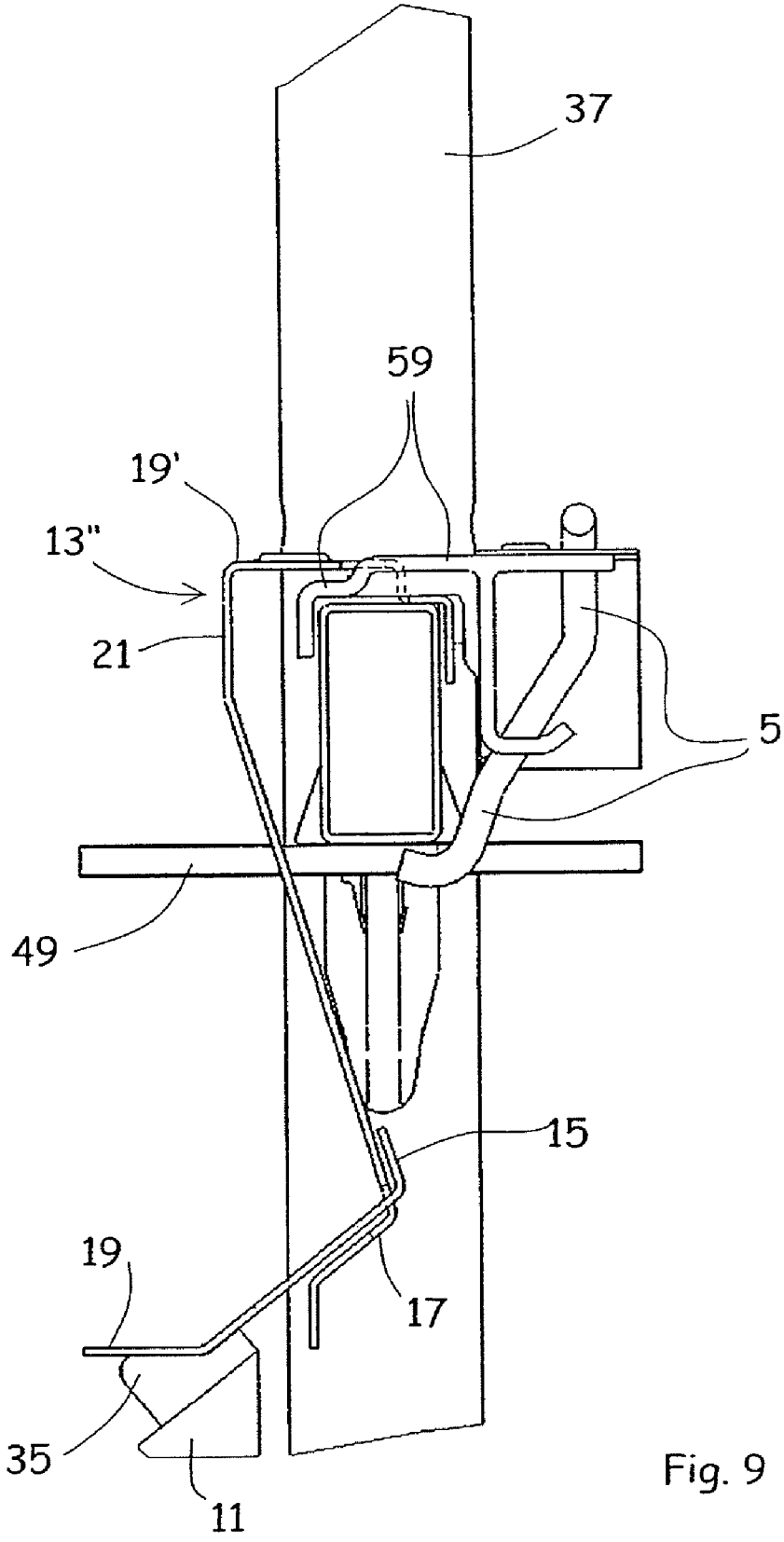
FIG. 9 is a cross-section through the topmost step element and a scaffold platform adjoining it and having longitudinally extending scaffold platform elements.

If, instead of transversely extending scaffolding platform elements, longitudinally extending scaffolding platform elements are used, the cap yokes 59 (FIG. 9) of the scaffolding platform elements are used as the securing device and are partly guided through orifices 63 (FIG. 7) of the step tread 19 of the topmost step element 13" to enable a fastening at the transversely extending horizontal latch 43 at which the step tread 19 of the topmost step elements 13" is hung.

The assembly of scaffolding steps in accordance with the invention will be explained below with reference to the drawing.

First, the vertical supports 37 are erected and the step strings 11, in particular their branching latches 41, and the horizontal latches 39, 43 are hung at roses 49 of the vertical supports 37.

Subsequently, the scaffolding platform 45, which is arranged beneath the bottommost step element 13' with assembled scaffold steps, is placed in and is fastened by means of support and securing yokes 59, 59' to longitudinally extending horizontal latches 39 and is thereby secured against lift-off.

Subsequently, the bottommost step element 13' is oriented such that the riser 21 is aligned approximately horizontally. The bottommost step element 13' is moved from this starting position by turning of the lateral cut-outs 29 and the openings 33 of the riser 21 into the two projections 27, 31 into an end position which will be explained in more detail in the following in connection with the middle step elements 13. At the same time, the step tread 19 of the bottommost step element 13 lies on the support surfaces 35 of the next higher holding devices 25.

Figure 3:
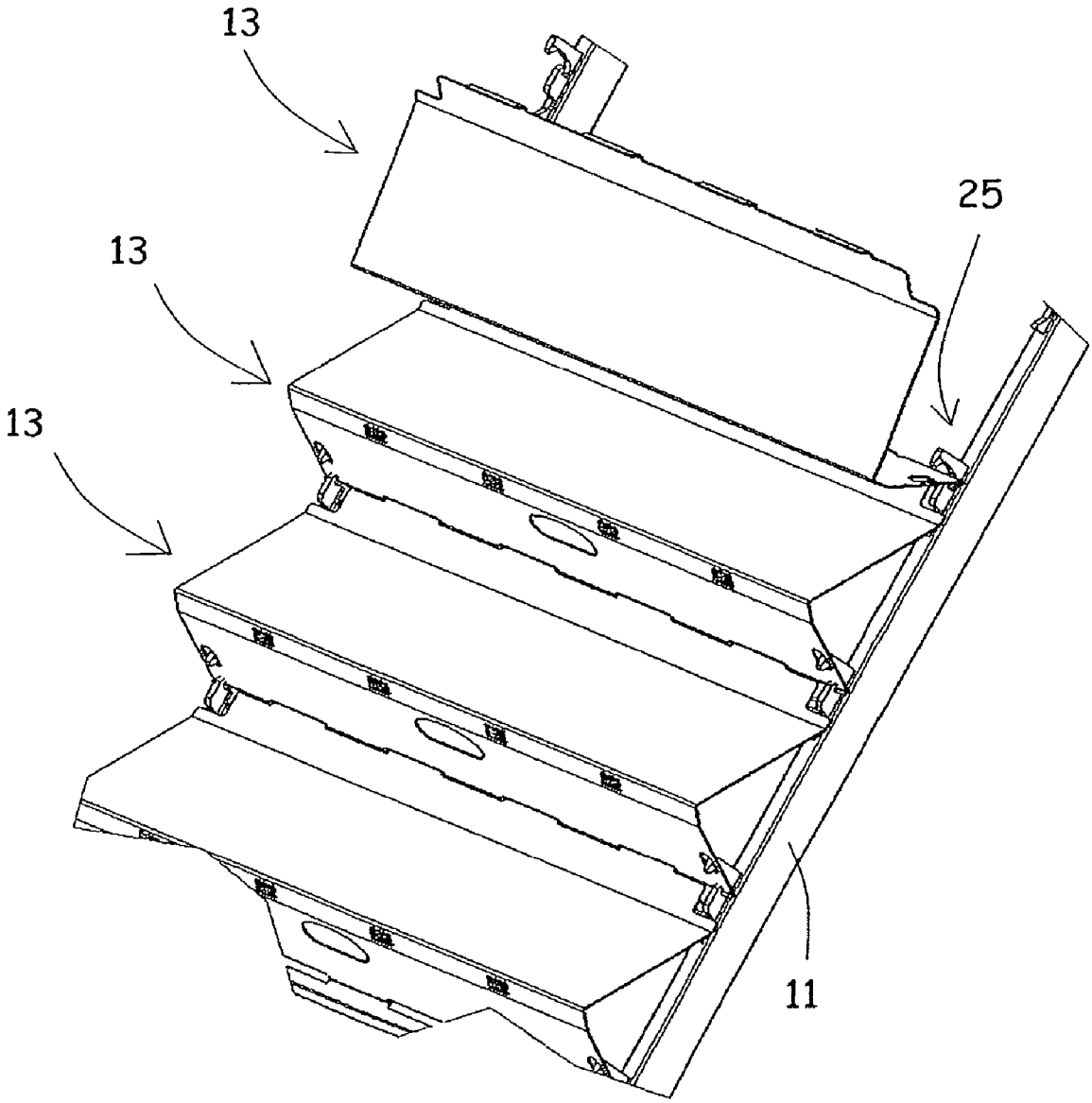
FIG. 3 is a perspective view of a section of scaffold steps in accordance with the invention with a step element at the start of its assembly.

Next, a first middle step element 13 is assembled. For this purpose, the first middle step element 13 is likewise oriented such that the riser 21 is aligned approximately horizontally, as is shown in FIG. 3 for any desired middle step element 13. For the releasable coupling of the middle step element 13 with the step element 13, 13' disposed thereunder, the lugs 15 of the lower step element 13, 13' are first threaded into the recesses 17 of the upper step element 13 or are plugged therethrough. Subsequently, the upper step element 13 is moved from this starting position (FIG. 3) by being set upright into an end position (FIG. 5), with the lateral cut-outs 29 and grips 33 of the riser 21 being turned into the two projections 27, 31 on this movement until the step tread 19 of the first middle step element 13 lies on the support surfaces 35 of the next higher holding devices 25. The cut-outs 65 (FIG. 2) of the step tread 19 enable the step tread 19 to be turned past the projection 27 in the assembly. The first middle step element 13 secures the bottommost step element 13' against lift-off.

Then all the other middle step elements 13 are assembled step-wise in the same procedure, with a step element 13, 13' in each case being secured by the step element 13 arranged directly above it with assembled scaffolding steps.

Once all middle step elements 13 are assembled, the topmost step element 13" is assembled. For this purpose, the recesses 17 of the topmost step elements 13" are threaded into the lugs 15 of the last middle step element 13, and the topmost step element 13" is set upright and is rotated via a transversely extending horizontal latch 43. The topmost step element 13" secures the last middle step element 13 against lift-off.

The topmost step element 13" is itself secured against lift-off with assembled scaffold steps by the directly adjoining scaffolding platform 47 which is fastened by means of conventional cap and securing yokes 59, 59' at longitudinally extending or transversely extending horizontal latches 39, 43.

Finally, or alternatively also before the assembly of the step elements 13, 13', 13", the railing elements 51 are assembled by hanging at rosettes 49 of the vertical supports 37.

Figure 10:
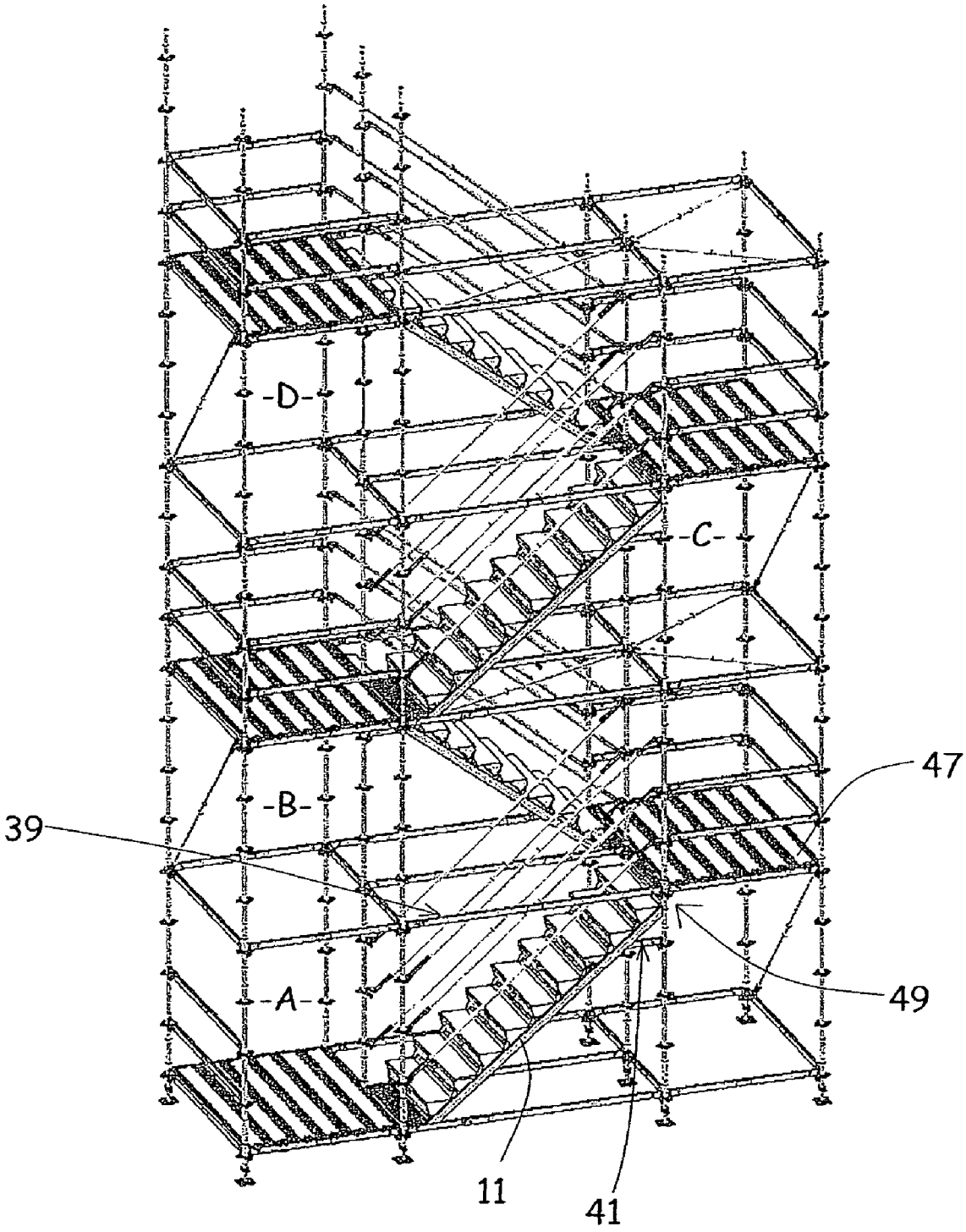
FIG. 10 is a perspective view of scaffolding having a plurality of levels and a plurality of scaffold steps in accordance with the invention.

In FIG. 10, a scaffolding is shown having a plurality of levels A to D which each have steps in accordance with the invention. The advantage of a latch 41 branching off beneath the actual end of the side strings 11 in particular becomes clear from FIG. 10. The rose 49 arranged at the level of the scaffolding platform 47 hereby remains unoccupied at the corresponding position so that a longitudinally extending horizontal latch 39 of a further level can be hung in.

In FIGS. 11 to 14, scaffold steps in accordance with the invention in accordance with a further embodiment are shown. The above description with respect to FIGS. 1 to 10 can be transferred identically to the further embodiment to the extent that it does not contradict FIGS. 11 to 14. In the following, in particular only differences of the further embodiment with respect to the embodiment shown in FIGS. 1 to 10 are explained. Like or corresponding parts are designated with the same reference numerals.

A step element 13, 13' in accordance with the further embodiment of the invention, in particular a lower and/or a middle step element, substantially corresponds to a step element 13, 13', as is shown, for example, in FIG. 2. With respect to the step element 13, 13' of FIG. 2, in accordance with FIG. 11, the lugs 15 and the recesses 17 are arranged actually reversed with respect to the step tread 19 and the riser 21; i.e. the step tread 19 has a plurality of recesses 17 arranged next to one another and respectively formed at the section upwardly angled by the edge 53 and the riser 21 has a plurality of lugs 15 which are L-shape seen in cross-section, which are arranged next to one another and extend in each case downwardly obliquely away from the section of the riser 21 angled forwardly by the edge 57, with only one recess 17 and one lug 15 being shown in FIG. 11.

Furthermore, the step tread 19 of the step element 13, 13' has in each case on both sides a stamped hole 67 at its upwardly angled section. The riser 21 of the step element 13, 13' has in each case on both sides a cut-out 29 formed as an elongate hole at its forwardly angled section, with the elongate hole 29 having a circular extension at one end (FIGS. 12, 13) to enable a passing through of the head of a mushroom-shaped projection, as will be explained in more detail at another point.

The riser of a topmost step element, not shown, in accordance with the further embodiment of the invention is made in accordance with the riser 21 of a lower and/or of a middle step element 13, 13' in accordance with the further embodiment of the invention.

Figure 11:
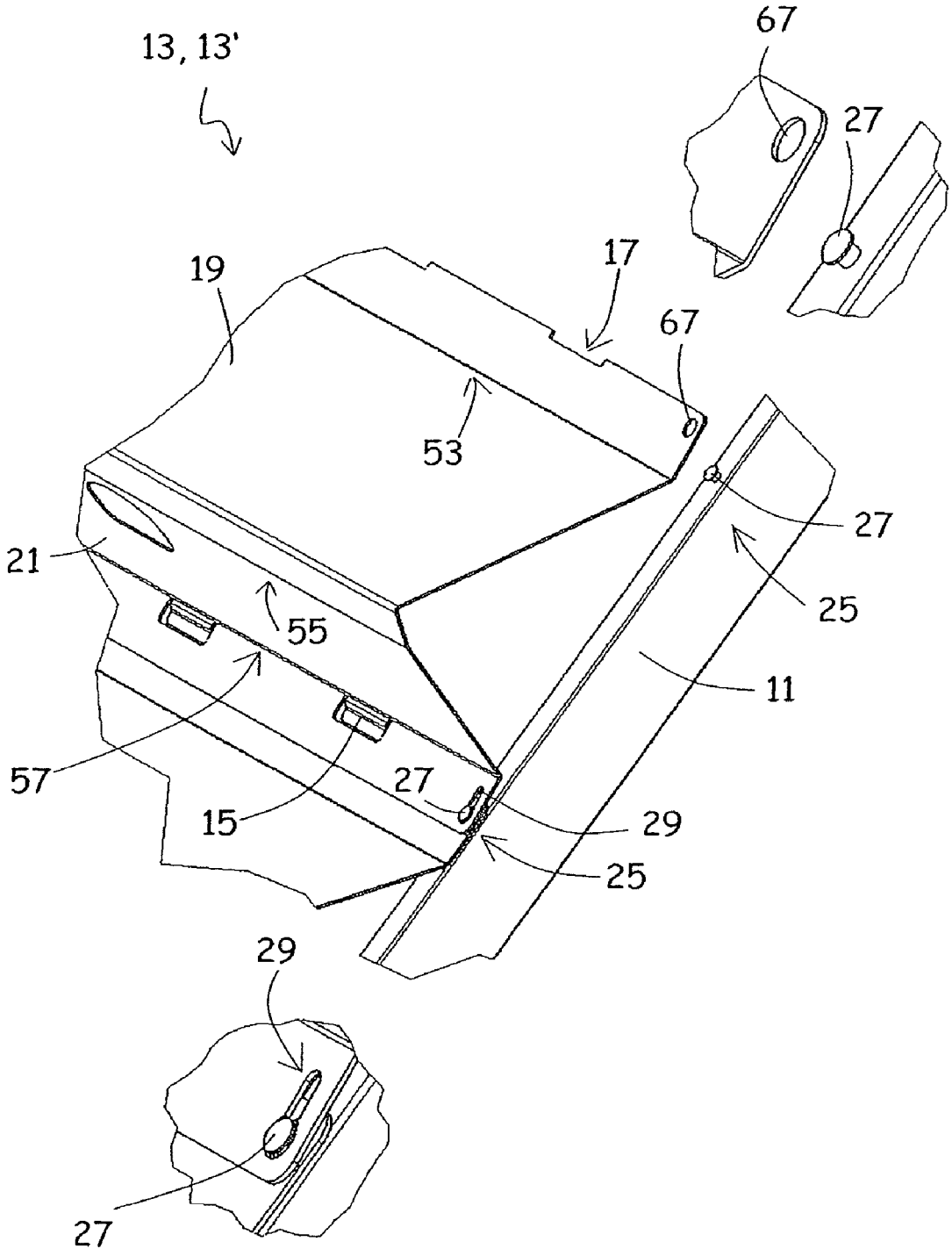
FIG. 11 is a perspective view of a section of scaffold steps in accordance with the invention in accordance with a further embodiment with a step element at the start of its assembly.

A holding device 25 in accordance with the further embodiment in particular includes, in accordance with enlarged representations in FIG. 11, an upwardly projecting mushroom-shaped projection 27 welded to the side strings 11 and having a head which engages into the elongate hole 29 of the corresponding side of a corresponding step element 13, 13' with assembled steps.

Furthermore, the holding device 25 includes a further upwardly projecting mushroom-shaped projection 27 welded to the side strings 11 and having a head which engages into the stamped hole 67 of the corresponding side of a corresponding step element 13, 13' for the locking of the step tread 19 with assembled steps.

For the assembly of a step element 13, 13' in accordance with the further embodiment, the step element 13, 13' is first oriented such that the step tread 19 is aligned approximately horizontally. Then, the projection 27 is introduced into the circular extension of the elongate hole 29 whose diameter is matched to the diameter of the head of the projection 27 (FIG. 11).

Figure 12:
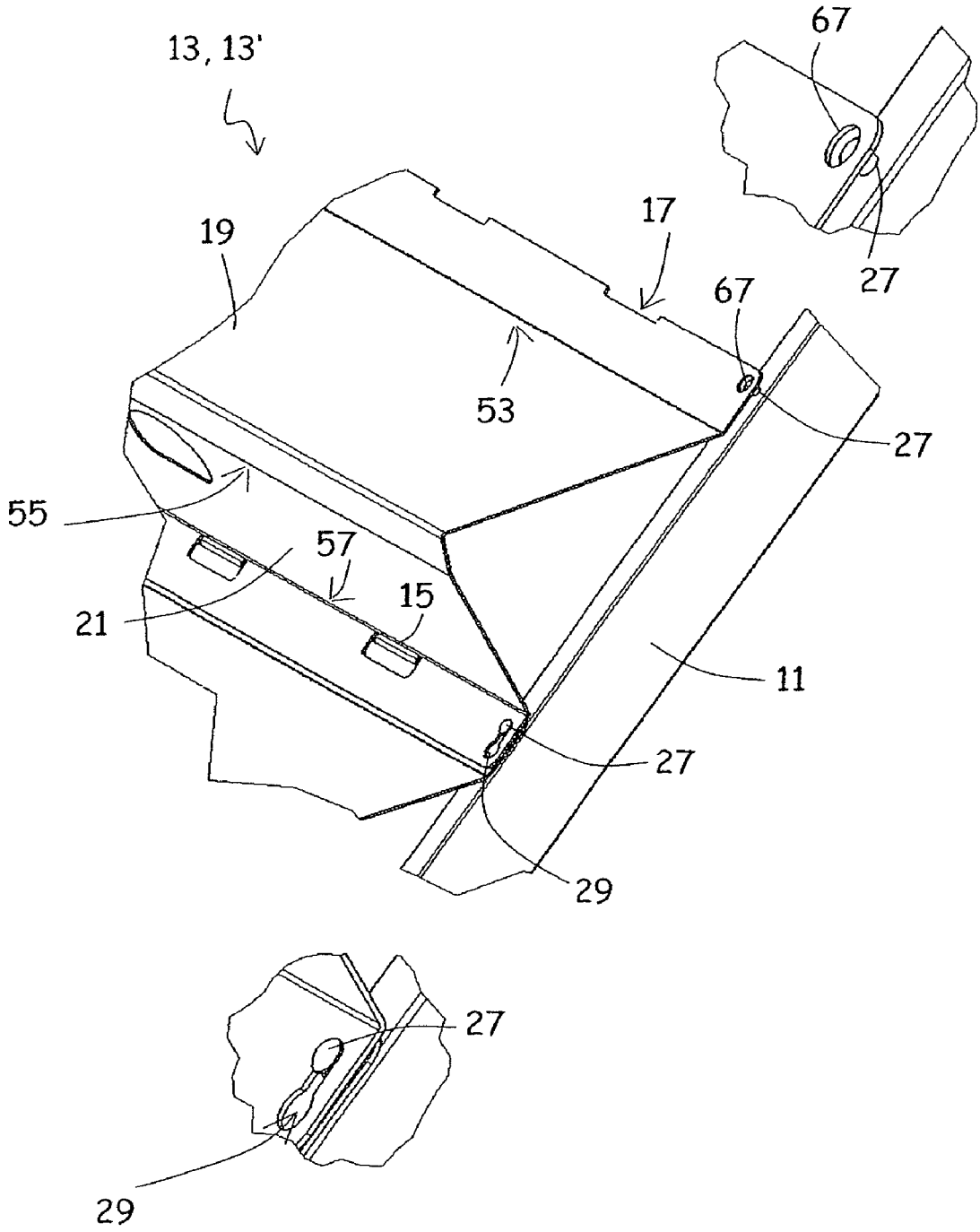
FIG. 12 is a perspective view of a section of scaffold steps in accordance with the invention in accordance with the further embodiment with an almost completely assembled step element.
Figure 13:
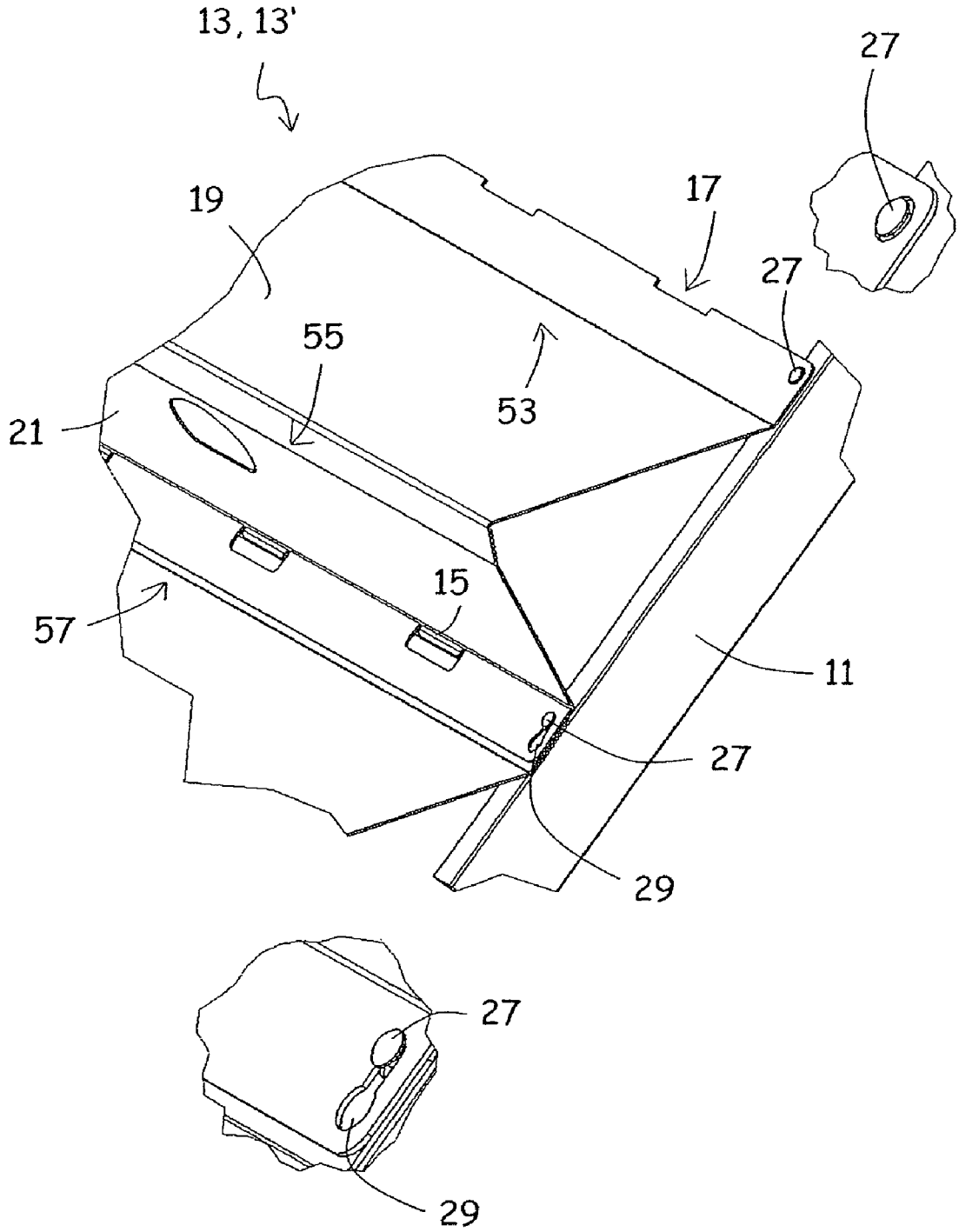
FIG. 13 is a perspective view of a section of scaffold steps in accordance with the invention in accordance with the further embodiment with a completely assembled step element.

Subsequently, the step element 13, 13' is moved along the longitudinal direction of the side strings 11 so that the head of the projection 27 cooperates with a section of the elongate hole 29, wherein the width of the elongate hole 29 is smaller than the diameter of the head, with simultaneously the lugs 15 of the step element 13, 13' to be assembled being plugged into the recesses 17 of the step element 13, 13' arranged thereunder, the recesses not being visible due to the selected perspective (FIG. 12).

Finally, the step element 13, 13' is pivoted slightly around an axis extending in the transverse direction to achieve an engagement of the further projection 27 into the stamped hole 67 of the step tread 19 (FIG. 13) in order thus to prevent a displacement of the step element 13, 13' along the longitudinal direction of the side strings 11.

Figure 14:
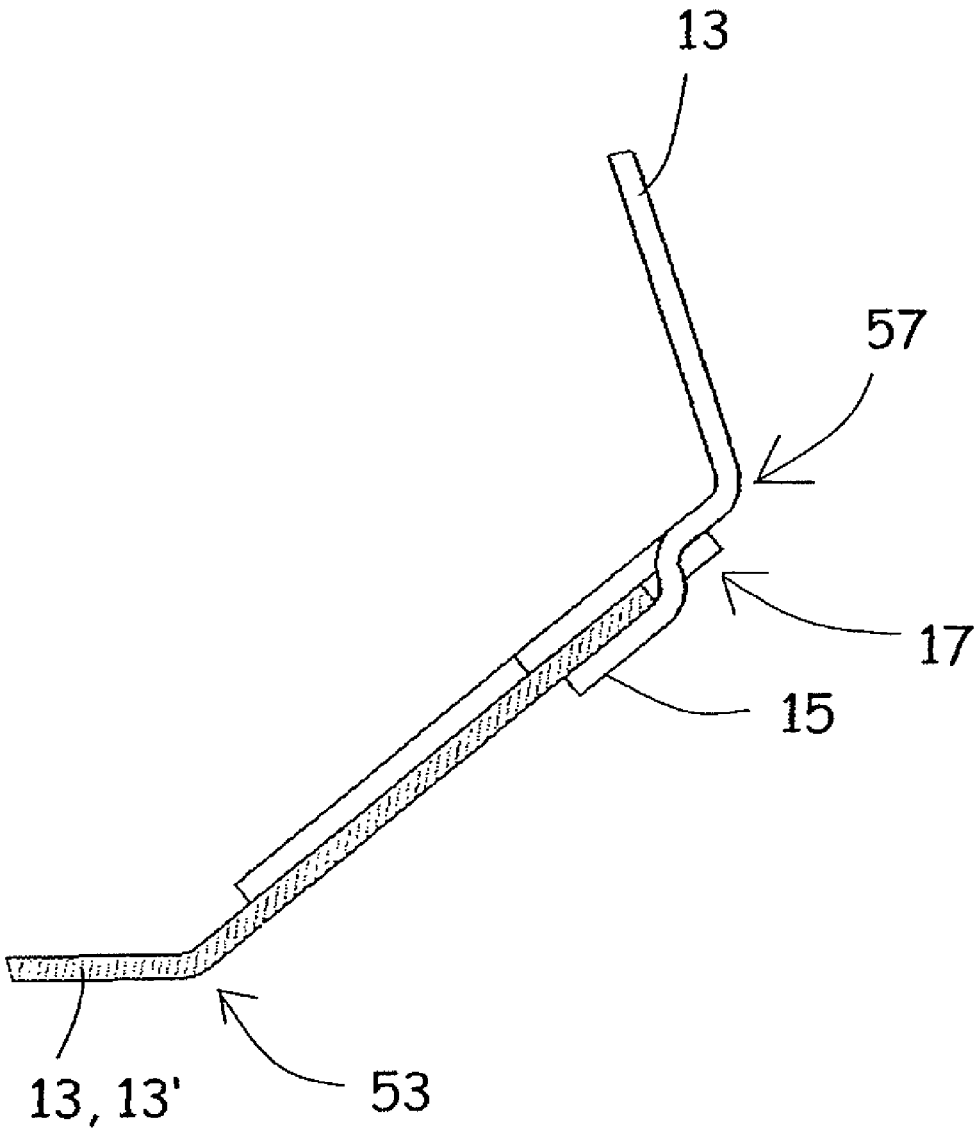
FIG. 14 is a cross-section through the transition region between two step elements of scaffold steps in accordance with the invention in accordance with the further embodiment.

FIG. 14 shows an upper step element 13, shown not hatched, and a lower step element 13, 13', shown hatched, which are coupled to one another. For this purpose, the lugs 15 of the upper step element 13 engage or are plugged into the recesses 17 of the lower step element 13, 13'. The section of the lower step element 13, 13' upwardly angled by the edge 53 is clamped in the manner of pliers by the lug 15 and the section of the upper step element 13 forwardly angled by the edge 53.

REFERENCE NUMERAL LIST 11 side string
13 middle step element
13' bottommost step element
13" topmost step element
15 lug
17 recess
19 step tread
19' step tread section
21 riser
23 grip opening
25 holding device
27 projection
29 cut-out
31 projection
33 opening
35 support surface
37 vertical support
39 longitudinally extending horizontal latch
41 branching latch
43 transversely extending horizontal latch
45 scaffolding platform
47 scaffolding platform
49 rose
51 railing element
53 edge
55 edge
57 edge
59 cap yoke
59' securing yoke
63 orifice
65 dimple
67 stamped hole

The invention claimed is:

1. Scaffold steps, comprising:

two side strings, each side string comprising holding devices, which are integral thereto, the holding devices each comprising at least one hook-shaped or mushroom-shaped projection which projects directly from the side string; and a plurality of step elements, each comprising a lateral opening configured for the hook-shaped or mushroom-shaped projection to engage therein such that the holding devices hold the step elements in releasable coupling to the side strings, wherein the step elements are further configured to be directly releasably coupled to one another.

2. Scaffold steps in accordance with claim 1, wherein the step elements other than a topmost step element are each secured against lift-off by step elements directly thereabove with assembled scaffold steps.

3. Scaffold steps in accordance with claim 1 wherein a topmost step element is securable against lift-off by a scaffolding platform adjoining the topmost step element with assembled scaffold steps.

4. Scaffold steps in accordance with claim 1, wherein the step elements are configured to be releasably coupled to one another by threading in, pushing through, plugging in or engagement of one or more connection elements of one of the step elements into or through one or more recesses of an adjacent one of the step elements.

5. Scaffold steps in accordance with claim 1, wherein each of the step elements is manufactured from a single areal element by stamping and bending.

6. Scaffold steps in accordance with claim 1, wherein the holding devices are welded to the side strings.

7. Scaffold steps in accordance with claim 1, wherein the hook-shaped or mushroom-shaped projection projects upwardly.

8. Scaffold steps in accordance with claim 1, wherein each holding device comprises a first and a second projection, and the step element further comprises a lateral cut-out, wherein the first projection is configured to engage into the lateral cut-out and the second projection is configured to engage into the lateral opening.

9. Scaffold steps in accordance with claim 1, wherein a topmost step element differs in construction from other step elements.

10. Scaffold steps in accordance with claim 1, wherein at least some of the step elements are identical to one another.

11. Scaffold steps in accordance with claim 1, comprising metal, a metal alloy, steel, plastic or a composite material.

12. Scaffold steps in accordance with claim 1, further comprising at least four vertical supports and at least two longitudinally extending horizontal latches, each configured to connect two of the vertical supports, wherein each side string is releasably fastenable to at least one of the vertical supports or to one of the longitudinally extending horizontal latches.

13. Scaffold steps in accordance with claim 12, further comprising a branching latch attached to an end of each side string configured such that the side string can be fastened to one of the vertical supports by means of said branching latch beneath a topmost step element of assembled steps.

14. Scaffold steps in accordance with claim 12, further comprising roses on the vertical supports configured for the side strings to be hung thereto.

15. Scaffold steps in accordance with claim 1, wherein each step element comprises a first limb defining a step tread, and a second limb defining a riser for the connection to an adjacent one of the step elements, which is disposed thereunder.

16. Scaffold steps in accordance with claim 15, wherein the first limb comprises at least one lug extending away from the first limb in a straight, oblique or right angled manner, and wherein the second limb comprises at least one recess in an end region wherein the lug of the adjacent one of the step elements is configured to engage into said recess with assembled scaffold steps.

17. Scaffold steps in accordance with claim 15, wherein at least one of the limbs comprises an angled edge extending in the transverse direction of the step element.

18. Scaffold steps in accordance with claim 15, wherein each step element further comprises a grip opening disposed in the riser.

19. Scaffold steps in accordance with claim 15, wherein each holding device further comprises a support surface configured for the first limb to be supported thereon.

20. Scaffold steps in accordance with claim 15, wherein the first limb of a topmost step element extends generally horizontally in the assembled state and comprises an edge extending in the transverse direction of the topmost step element that is downwardly angled for engaging, hooking in or latching into a transversely extending horizontal latch.

* * * * *